United States Patent [19]

Genna

[11] Patent Number: 4,530,549

[45] Date of Patent: Jul. 23, 1985

[54] DISPLAY SYSTEM

[75] Inventor: Salvatore A. Genna, New Haven, Conn.

[73] Assignee: Neil C. Russo, East Haven, Conn. ; a part interest

[21] Appl. No.: 557,480

[22] Filed: Dec. 2, 1983

[51] Int. Cl.[3] ..... A47F 3/14

[52] U.S. Cl. ..... 312/121; 312/124

[58] Field of Search ..... D6/172, 173, 175, 181, D6/186; 312/117, 118, 119, 121, 122, 124; 211/490

[56] References Cited

U.S. PATENT DOCUMENTS

| | | | |
|---|---|---|---|
| 939,546 | 11/1909 | Plumer | 312/124 |
| 985,910 | 3/1911 | Lange | 312/122 |
| 1,463,179 | 7/1923 | Stephens | 312/117 |
| 1,716,032 | 6/1929 | Daugherty | 312/117 |
| 1,738,259 | 12/1929 | Newlander | 312/119 |
| 2,097,635 | 11/1937 | Mayo | 312/118 |
| 2,248,633 | 7/1941 | Lee | 312/124 |
| 2,492,912 | 12/1949 | Womack | 312/119 |

FOREIGN PATENT DOCUMENTS

| | | | |
|---|---|---|---|
| 590235 | 6/1925 | France | 312/124 |

*Primary Examiner*—Victor N. Sakran
*Assistant Examiner*—Joseph Falk
*Attorney, Agent, or Firm*—Costas, Montgomery & Dorman

[57] ABSTRACT

A display case with shelves for supporting transparent display and dispensing bins, and the display case defines unclosed windows in the front thereof. The bins are supported on the shelves with the front walls thereof forming a closure for the open window and presenting the merchandise in the bins. The bins are generally of L-shape in side elevation having a tall forward hopper portion and a rear dispensing tray portion. The bins may be individually removed for refilling and returned to the display case. The display case and the bins are formed to provide an attractive display of the merchandise.

3 Claims, 4 Drawing Figures

DISPLAY SYSTEM

FIELD OF THE INVENTION

This invention relates to display systems and more particularly relates to a display system and case in which various items such as nuts or candy are stored and displayed in individually removable modules or bins.

BACKGROUND OF THE INVENTION

At the present time, articles of food which are offered for sale such as nuts or individual pieces of candy are generally stored and displayed in a case which has dividers defining fixed bins for each different type of food, and which has a transparent window so that the prospective buyer may view the contents of each bin. In these known types of devices, each bin in a display case must periodically be refilled from inventory, and the bins for individual types of foods are not removable for transportation to the inventory source.

These types of display cases are relatively heavy and expensive and tend to be of standard dimensions not necessarily suited for the display and dispensing of all types of merchandise.

Accordingly, the present invention provides a display and dispensing system which is inexpensive in construction and provides modular storage bins for each item to be displayed and dispensed. The modular storage bins may be removed from the overall system and taken to an inventory source for refilling and then returned to the display system. Moreover, the modular storage items are so designed and arranged that they also help define the enclosure for the front window of the display system.

An object of this invention is to provide a new and improved display and dispensing system for items of food such as nuts and candy.

A further object of this invention is to provide a display and dispensing system in which new and improved modular bins are provided for different types of foods such as nuts and candy and may be removed from the display system for refilling at an inventory source.

The features of the invention, which are believed to be novel, are particularly pointed out and distinctly claimed in the concluding portion of this specification. The invention, however, both as to its operation and organization, together with further objects and advantages thereof, may best be appreciated by reference to the following detailed description taken in conjunction with the drawings.

SUMMARY OF THE INVENTION

The invention comprises a display case with shelves for supporting transparent display and dispensing bins, and the display case defines unclosed windows in the front thereof. The bins are supported on the shelves with the front walls thereof forming a closure for the open window and presenting the merchandise in the bins. The bins are generally of L-shape in side elevation having a tall forward hopper portion and a rear dispensing tray portion. The bins may be individually removed for refilling and returned to the display case. The display case and the bins are formed to provide an attractive display of the merchandise.

DESCRIPTION OF THE PREFERRED EMBODIMENT OF THE INVENTION

Figure 2:
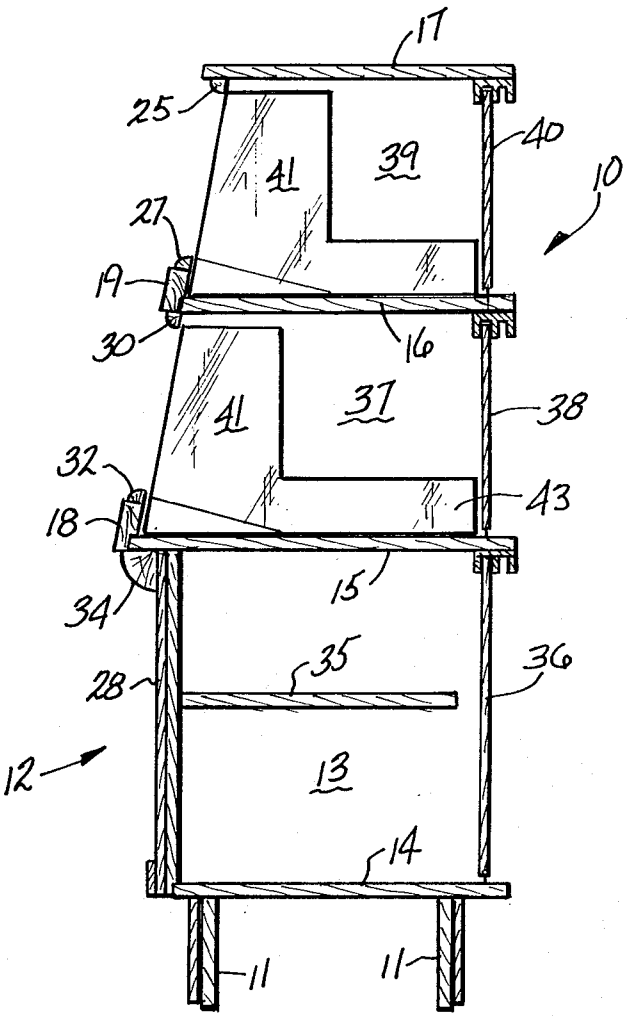
FIG. 2 is a side elevation in section seen in the plane of lines 2—2 of FIG. 1.
Figure 1:
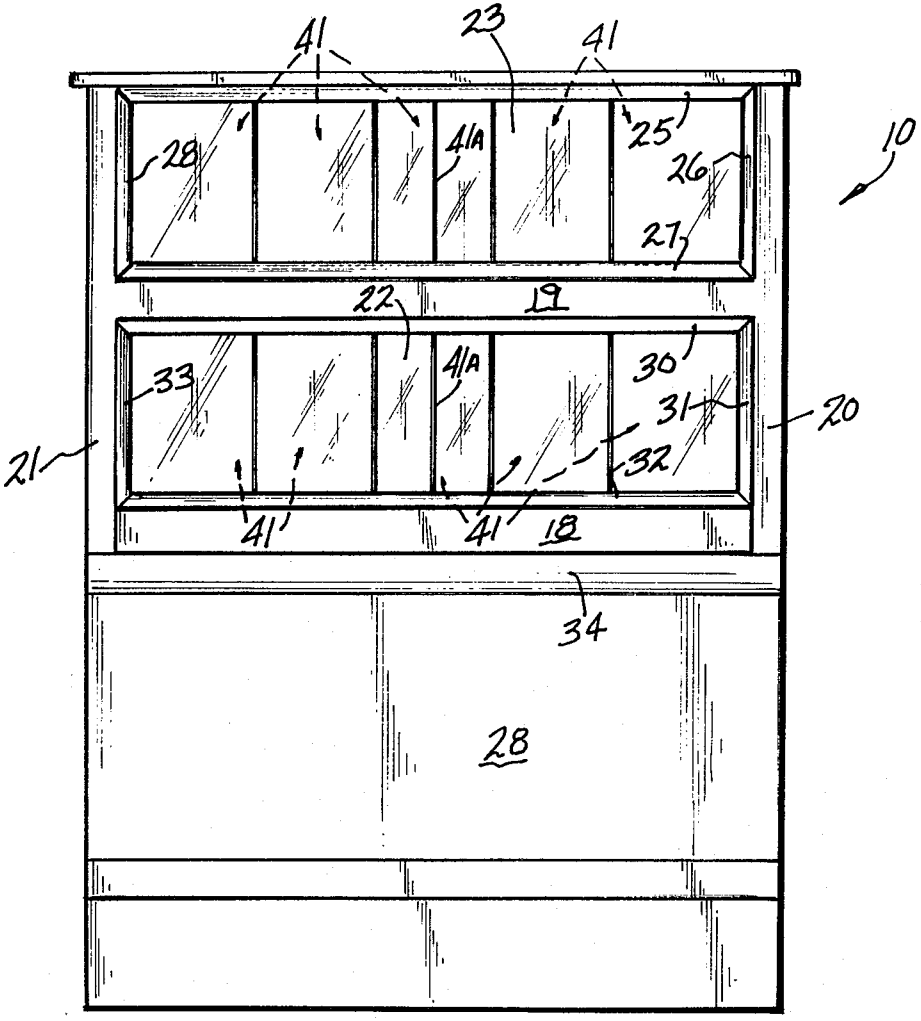
FIG. 1 is a front elevation of a display and dispensing system embodying the invention.

Referring to FIGS. 1 and 2, a display case 10 is supported on a base frame. The base frame 11 supports a base portion 12 which extends between spaced-apart vertical side walls 13 (only one shown in FIG. 2). Base member 12 comprises a bottom platform 14 and an upper support member or shelf 15. Members 14, shelf 15, and shelf 16 extend between side walls 13. A top wall 17 extends across side walls 13. A facia member 18 extends across the front edge of shelf 15 and extends upwardly therefrom. A facia member 19 extends across the front edge of shelf 16 and extends upwardly therefrom. The facia members 18 and 19, together with upright members 20 and 21, define elongated open windows 22 and 23. Decorative molding strips 25. 26, 27, and 28 may be provided about the window opening 23 and decorative molding strips 30, 31, 32, and 33 may be provided about window opening 22. A further decorative molding 34 is placed at the junction of shelf 15 and a facia member 28.

Base member 12 may further include a shelf 35 extending between side walls 13. The interior of base member 12 may be utilized for storage of food item inventory. The rear of base portion 12 may be closed as by sliding doors, as exemplified by the door 36. Similarly, the rear of a compartment 39, defined by shelf 16 and top wall 17, may receive sliding doors 40 (only one shown) and the compartment defined by shelf 16, and shelf 15 likewise may have a pair of sliding doors 38 (only one shown).

Figure 4:
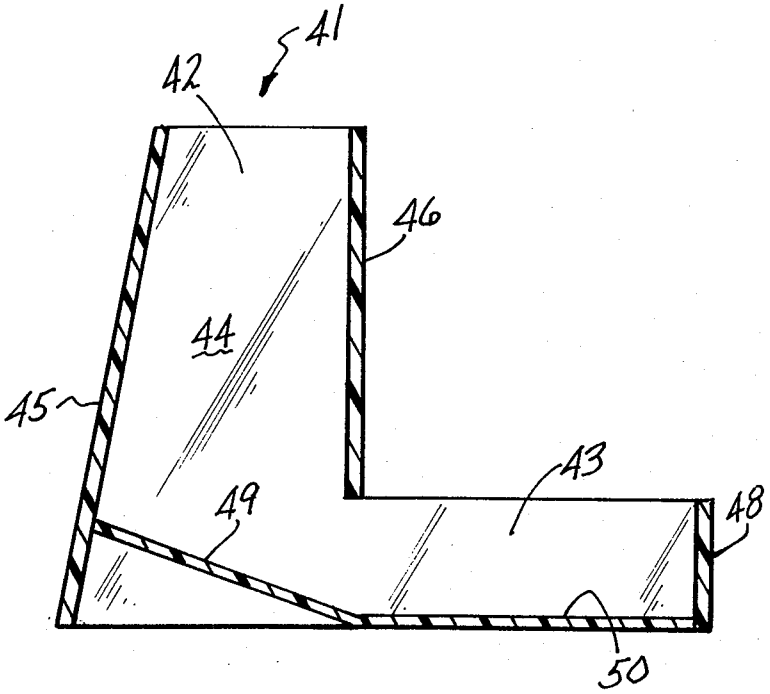
FIG. 4 is a sectional side elevation of the bin of FIG. 3, seen in the plane of lines 4—4 of FIG. 3.
Figure 3:
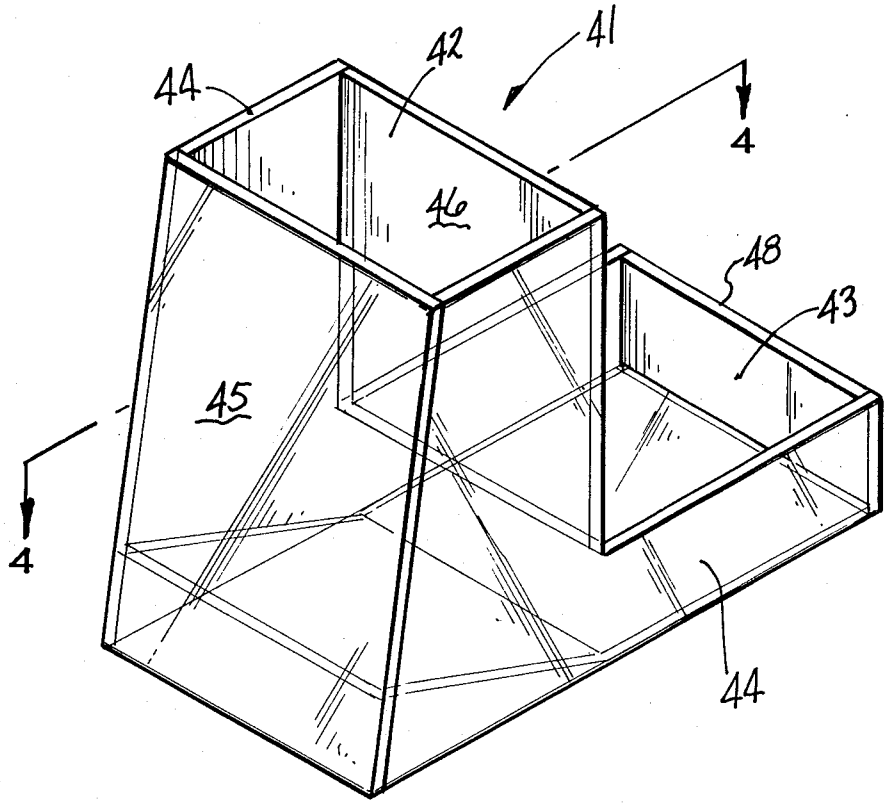
FIG. 3 is a perspective view of a display and dispensing bin, which is utilized in the display system of FIGS. 1 and 2.

The compartments 37 and 39 are arranged to receive display and dispensing bins 41 for nuts, candy, and the like. As exemplified in FIGS. 3 and 4, each of the bins 41 includes a forward hopper and display portion 42, which is open at the top, and a rearwardly extending tray dispensing portion 43, which is also open at the top, for removal of the contents. Containers 41 are defined by a pair of spaced-apart, generally L-shaped side walls 44, a front wall 45, a back wall 46. Back wall 46, together with the side walls 44 and front wall 45, defines the hopper and display portion 42. A rear wall 48, together with side walls 44, forms the tray or dispensing portion 43 from which the contents may be removed typically by the usual shovel-like spoon. A baffle member 49 extends from front wall 45 downwardly to a base member 50. Baffle member 49 joins base member 50 substantially under wall 46 and aids in the gravity feed of food in the hopper portion to the dispensing portion.

The bins 41 are made of a clear plastic material such as methel methacryate and the walls and base members thereof are joined with a transparent adhesive such as ketone. In some instances, a divider 41*a*, as exemplified in FIG. 1, may be formed integrally with a bin 41 to define two separate compartments. Such divider has a shape to fit into the cross-section shown in FIG. 4. The divider 41*a* is adhered to walls 45, 46, and 48 during assembly of a bin and may also be adhered to base 50 and baffle 49. The use of a full size bin or the divided bin is determined by the type of contents and the rate at which a particular food will be sold.

Preferably, front wall 45 is angled inwardly from bottom to top to facilitate display of the contents.

The facia members 18 and 19 conceal the baffles 49 of the bins 41 and will provide a surface for signs indicating the name of the food in each bin and/or the price. The base portion 12 of the display case provides an inventory source for refilling of the bins 41.

When it becomes necessary to replace the contents of any bin, only that bin need be removed from area 37 or 39, refilled through the hopper portion, and replaced in the display case. The bins facilitate orderly stock rotation on a first-in, first-out basis as opposed to the usual compartments where new stock is placed on top of old stock. The front walls of the bins 41 not only display the contents of the bins, but when placed in the display case, provide a closure for the windows 22 and 23. The bins 41, which are placed on the lower shelf 15 may be made to have a longer rear portion 43, as shown in FIG. 2.

It has been found that the food in the hopper portion 42 remains fresher than that in the tray portion 43. This is due to little, if any, air circulation over the stock in the hopper portion 42, and such stock is not exposed to air until it enters the tray portion.

A display case is preferrably designed to provide backwardly angled display windows 22 and 23, and the front walls 45. Bins 41 are shaped to match the angling of the display windows.

It may thus be seen that the objects of the invention set forth as well as those made apparent from the preceding description are efficiently obtained. Modifications to the disclosed embodiment of the invention, as well as other embodiments thereof, may occur to those skilled in the art. Accordingly, the appended claims are intended to cover all modifications of the invention and other embodiments thereof which do not depart from the spirit and scope of the invention.

What is claimed is:

1. A display case comprising a member defining spaced vertical side walls, shelves extending between said case side walls, a facia member extending across the front of each of said shelves and extending upwardly therefrom, a top member extending between said case side walls, whereby said top member, said case side walls, and said facia members define horizontally elongated open windows, a plurality of transparent bins on said shelves, said bins comprising a base member, spaced-apart, substantially L-shaped bin side walls, a front wall and a back wall defining a hopper portion with the vertical legs of said bin side walls, said bin back wall being spaced from said bin bottom wall, a baffle member extending between said bin side walls from the front wall thereof to said base member substantially under the back wall of said upright portion, said bins having an open tray portion behind said hopper portion defined by the horizontal legs of said bin side walls, said base and a rear wall for removal of articles from said bins, said hopper portion being substantially taller than said tray portion, said facia members concealing said baffles in said bins, said bins being positioned side by side on said shelves, the front walls of said bins forming a closure for said open window, and displaying contents of said bins therethrough.

2. The display case of claim 1 wherein said display case side walls, said facia members and the front walls of said bins are inclined backwardly from bottom to top.

3. The display case of claim 2, wherein the bins on the lower shelf have longer tray portions than the bins on the upper shelf.

* * * * *